US009731433B1

(12) United States Patent
Shumaker

(10) Patent No.: US 9,731,433 B1
(45) Date of Patent: Aug. 15, 2017

(54) CEMENT FORMS HAVING PIN CONNECTED FORM SECTIONS

(71) Applicant: James J. Shumaker, Swartz Creek, MI (US)

(72) Inventor: James J. Shumaker, Swartz Creek, MI (US)

( * ) Notice: Subject to any disclaimer, the term of this patent is extended or adjusted under 35 U.S.C. 154(b) by 0 days.

(21) Appl. No.: 14/614,399

(22) Filed: Feb. 4, 2015

Related U.S. Application Data

(60) Provisional application No. 61/935,829, filed on Feb. 4, 2014.

(51) Int. Cl.
*B28B 7/00* (2006.01)

(52) U.S. Cl.
CPC ..... *B28B 7/0029* (2013.01); *B28B 7/0014* (2013.01)

(58) Field of Classification Search
CPC ..... B28B 7/005; B28B 7/0014; B28B 7/0029; B28B 2007/0052
USPC ..... 249/1, 2, 3, 4, 5, 6, 7, 163, 165; 52/656.9, 656.7, 656.6, 200, 300; 446/111, 122; 403/295
See application file for complete search history.

(56) References Cited

U.S. PATENT DOCUMENTS 1,295,850 A * 3/1919 Carr ..... E01C 19/506 249/4
1,644,584 A * 10/1927 Heltzel ..... E01C 19/506 249/157
1,947,413 A * 2/1934 Hay ..... E02D 5/60 249/1
2,775,019 A 12/1956 Bemis
3,021,586 A * 2/1962 Uruburu ..... E04G 13/02 249/165
3,242,833 A * 3/1966 Sondheim ..... E01C 19/502 249/208
3,528,692 A * 9/1970 De Vries ..... E06B 3/962 403/295
4,023,766 A 5/1977 Lubov
4,099,815 A * 7/1978 Cox ..... A47B 88/0014 312/111
4,123,034 A * 10/1978 Crunk ..... E02D 29/14 249/100
4,125,980 A 11/1978 Miraldi
4,303,289 A * 12/1981 Hardy ..... F16B 12/50 312/140

(Continued)

FOREIGN PATENT DOCUMENTS

WO WO 2008058312 * 5/2008 ..... B28B 7/0014

*Primary Examiner* — Michael Safavi
(74) *Attorney, Agent, or Firm* — Flint Patent Service; Jack E. Tubbs

(57) ABSTRACT

A form for curable construction materials, comprising an elongated, substantially planar wall having a selected thickness, the wall having inner and outer surfaces, a flange region extending from the wall, the flange region having a flange substantially running the length of the wall, wherein a bore substantially running the length of the wall is formed adjacent the wall and the flange, the flange region further having first and second angled surfaces extending therefrom, wherein a channel extending to the bore is formed between the first and second angled surfaces, wherein one form may be assembled with other forms using pins inserted into respective bores to create a containment system for construction materials.

2 Claims, 5 Drawing Sheets

(56) References Cited

U.S. PATENT DOCUMENTS 4,451,022 A * 5/1984 Sauger ..... E04G 13/00 249/158
4,783,935 A 11/1988 Creager
4,846,437 A 7/1989 Fitzgerald
4,863,307 A 9/1989 Jones
5,102,272 A 4/1992 Woods
5,399,050 A 3/1995 Jacobus
5,636,936 A * 6/1997 Kremser ..... A01G 9/1476 403/282
6,021,994 A 2/2000 Shartzer, Jr.
6,070,375 A * 6/2000 Anderson ..... E04G 15/02 49/504
6,195,956 B1 3/2001 Reyneveld
6,712,546 B1 * 3/2004 Radu, Jr. ..... B28B 7/0014 404/8
6,761,345 B1 7/2004 Reyneveld
6,918,567 B2 * 7/2005 Ward ..... E04G 13/00 249/189
7,596,918 B2 10/2009 Hills
8,011,144 B2 9/2011 Compton
8,028,489 B1 * 10/2011 Lawrence ..... E06B 3/9641 52/204.57
8,579,248 B2 11/2013 Ray
8,967,587 B1 * 3/2015 Timoshchuk ..... E01C 19/502 249/4
2001/0010410 A1 8/2001 Meehan
2006/0180732 A1 8/2006 Lawrence
2008/0265127 A1 * 10/2008 Sladojevic ..... B28B 7/0011 249/189
2010/0327145 A1 * 12/2010 Savard ..... E01C 19/502 249/5
2011/0278765 A1 11/2011 Ray
2013/0001831 A1 1/2013 Ray

* cited by examiner

CEMENT FORMS HAVING PIN CONNECTED FORM SECTIONS

CROSS-REFERENCE TO RELATED APPLICATIONS

This original utility patent application is based on and claims priority to U.S. Provisional Patent Application No. 61/935,829, filed on Feb. 4, 2014. Provisional Patent Application No. 61/935,829 is incorporated herein by reference in its entirety.

SUMMARY OF THE INVENTION

A form for curable construction materials, comprising an elongated, substantially planar wall having a selected thickness, the wall having inner and outer surfaces, a flange region extending from the wall, the flange region having a flange substantially running the length of the wall, wherein a bore substantially running the length of the wall is formed adjacent the wall and the flange, the flange region further having first and second angled surfaces extending therefrom, wherein a channel extending to the bore is formed between the first and second angled surfaces, wherein one form may be assembled with other forms using pins inserted into respective bores to create a containment system for construction materials.

DETAILED DESCRIPTION

Figure 1:
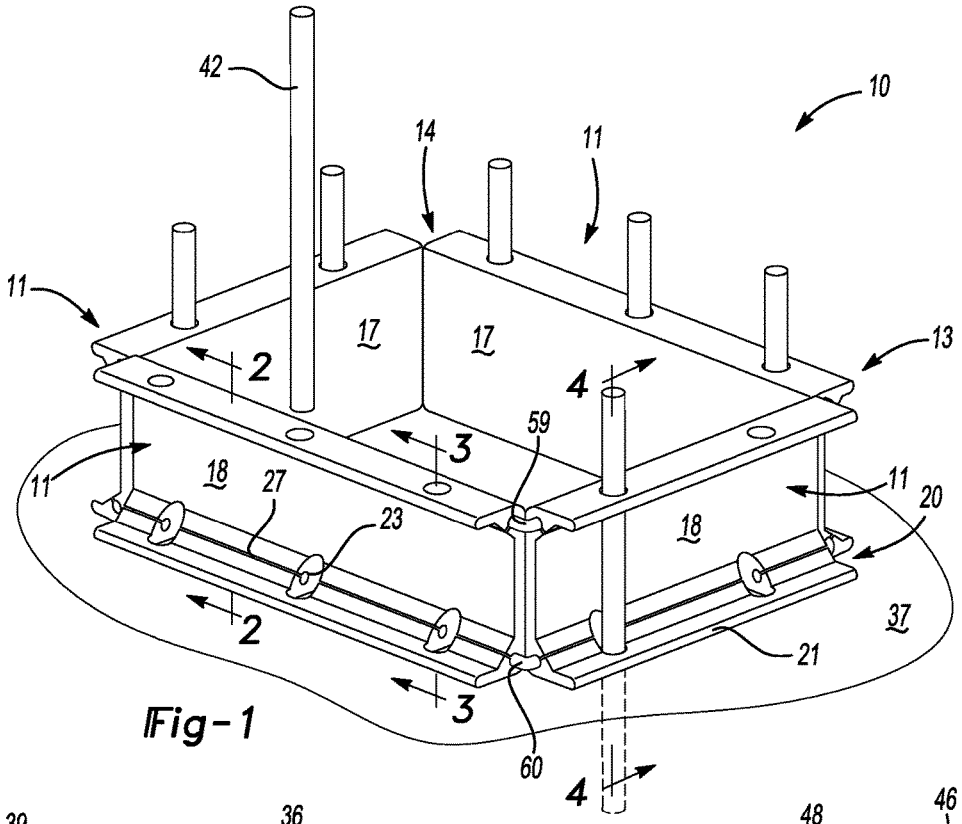
FIG. 1 is an isometric view of an embodiment of the containment system for curable construction materials.

This invention is a containment system for loads of various types at the heart of which is a unique single and multiple gusseted buttressing system which has as its main purpose to strengthen very light weight materials to the point of usefulness in construction and transportation applications now requiring much heavier, expensive and more labor intensive materials. The concepts for some potential uses for the technology are more fully described below.

Concrete Footing Forms:

In this particular application our technology would be best described as a system for containment or formations, if you will, for cast-in-place concrete in both above and below grade applications to replace existing technology which now employs the use of wood, steel, aluminum or other permanent heavy, bulky, expensive and unwieldy devices and materials. In contrast our technology offers the "primary" benefits of a flexible, lightweight, foldable, field modifiable, fast and easily installable forming system constructed of cardboard, corrugated cardboard, corrugated fiberboard, polyvinyl chloride (PVC) or any other material or combination of materials which provides the aforementioned benefits of being lightweight and flexible. The gusseted buttressing technology is a key concept in the utility of this invention and the ability of the technology design to provide strength, durability, ease of use, and stability. The forming material(s) would either be a moisture repelling material or be pretreated with moisture repelling technology to prevent absorption, before and during use, would be bent, scored, serrated and or perforated to facilitate "on the fly" field adjustments for dimension(s) and positioning to accommodate project designs and various cross-drainage tile configurations when used in below grade applications. Another key feature of this design for plastic or plasticized cardboard applications is the process of forming the positioning slots and holes which provide anchoring points for the staking re-rod material. The holes and slots are cut then formed into their final shape(s) through a combination of heat and pressure which crushes, pinches and fuses the substrate material in such a way that interior edging on the openings is bonded cohesively to form a grommet hole which will accommodate steel, brass or other metal grommet attachment(s) significantly strengthening the holes for durability and potential reuse. Additionally the forms include structural design(s) which facilitates the inclusion of a "stiffback" or bracing form such as but not limited to a "2×4" inch piece of lumber which adds strength to the design to better bear the vector force(s) of material poured into it. This sets in the upper one third of the height of the piece on the back side of the design hence the name stiffback.

The ergonomic, labor and cost saving secondary benefits of our design inure to the workers who currently must carry heavy forming materials into excavations or other sites, prepare, treat, oil, place and return days later to remove, clean and haul away for another use. Our technology provides the benefit of a "stay in place" option whereby all of the labor after the pours eliminated and the material left to deteriorate or decompose naturally. In the case of cardboard another option of "burn in place" is possible. Builders and general contractors will benefit from the cost savings this system provides since it is much less than methods now in common use. Setup can now be a one-person operation due to the folds, scores, bends, and the inherently lighter weight material. They will no doubt appreciate fewer on-the-job injuries and strains from heavier more cumbersome forms. Potential uses would encompass such projects as slabs of all types including basements, poured walls, driveways, patios, sidewalks, runways, tarmacs, water delivery systems etc.

Additional Pour-in-Place Products:

In cases where it might be necessary or desirable to pour parking lot curb stops on site or for foundation walls in basements or in other venues such as decorative gardening and landscape design where it may not be practical to deliver finished pieces or order cement delivered by truck, our technology includes a "form" or "mold" which can be used in conjunction with portable concrete machines for small jobs that will form and contain the pour in a lightweight material (size and shape can vary) until it sets. The form can then be removed and the object set or fastened in place. Lighting pole bases, flagpoles and the like may also be constructed by using this technology and simply "stacking" two or three forms to meet height requirement(s). The concrete may then be poured and allowed to cure in place before removing the form and discarding. Once again providing the unique ability to use lightweight, convenient, portable, inexpensive materials facilitated by the unique gusset and buttress design for strength and shape.

Trailer Box Container Form:

This use of our technology including all the previously mentioned folds, perforations, serrations, gussets, buttresses, dowels, cabling and retaining pins, collectively form a stable, strong shape out of various lightweight materials and in this use provides a container for such material as sand, loose gravel, pea rock etc., which lays on a trailer or truck bed such as a snowmobile-type or other open trailer forming an "immovable bed" for transport of the material while preempting spillage and load shifting.

The technology we seek to patent, license and/or sell to a manufacturer is not limited in scope to foundational concrete pours, but is more broadly described as an ultra-lightweight, portable, easily modifiable strengthening technology and containment system which conveys the benefits mentioned above with regard to empowering materials for uses not previously possible.

The first portion of a wall structure of an assembled containment system may have load-bearing structures selected from the group consisting of a stake, post, stick, dowel, channel, piece of angle iron, bar, reinforcing bar, rebar, rod, rerod, reinforcing wire, structure substantially extending below the surface of the ground and structure not substantially extending below the surface of the ground. This first portion of the wall structure is elongated and substantially flat. The second portion of a wall structure of an assembled containment system is shown (with seven load-bearing structures protruding "above" and "below" the second portion). The first and second portions together have a selected overall cross-sectional shape, wherein the selected cross-sectional shape is selected from the group consisting of substantially polygonal, triangular, rectangular, square, box, U-shape, W-shape, M-shape, Z-shape, T-shape, L-shape, J-shape, curved, arcuate, semicircular, and/or any combination thereof. Next in the photograph the connected first and second portions are shown, in "flat" form after fabrication and suitable for shipping multiple pieces in bulk. The first and second sections may be fabricated together as one component, and "connected" by a substantially continuous box seam for folding the sections. Alternatively, they may be connected along a line of serrations for folding the sections. Alternatively, they may be connected along a line of apertures, holes, or other features to facilitate folding the sections. Alternatively, the sections may separate prior to final assembly and be connected by fasteners such as metal or plastic rivets, clips, wires, nails, staples and/or nut-and-bolt combinations including pushnut/Palnut/Tinnerman nut-and-bolt combinations. The first and second portions are made from material(s) selected from the group consisting of cardboard, plastic foam, expanded foam sheeting, Styrofoam, closed-cell extruded polystyrene foam, expanded polystyrene foam, wood, natural wood, plywood, engineered wood product, engineered wood particle board, OSB, oriented strand board, sheathing, metal, polymer and plastic, and/or any combination thereof. The forms may be made (or made in part) using an extrusion process.

The form may be made of corrugated cardboards or corrugated fiberboards, although corrugated plastics or other materials or combinations of materials are also suitable.

A material composition such as cement, concrete, other aggregate mixtures, etc., may be poured within the containment region or space of the system. The form may be made of corrugated cardboards or corrugated fiberboards, although corrugated plastics or other materials or combinations of materials are also suitable.

A plurality of holes or apertures may accommodate the load-bearing structures used during final assembly of a wall structure. Multiple substantially in-line wall structures may be used to create forms of any desired overall length. These multiple wall structures may be "pinned" together at their ends by overlapping their respective end holes and securing them together with a common stake, section of rerod, section of rebar, etc.

Figure 2:
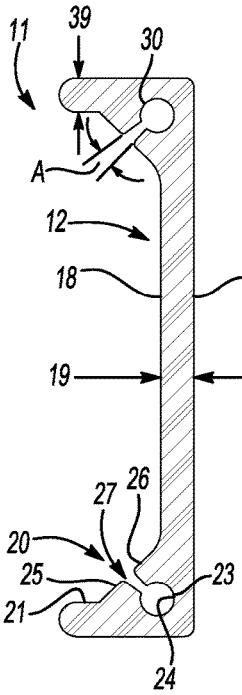
FIG. 2 is a sectional view along arrows 2-2 in FIG. 1.
Figure 6:
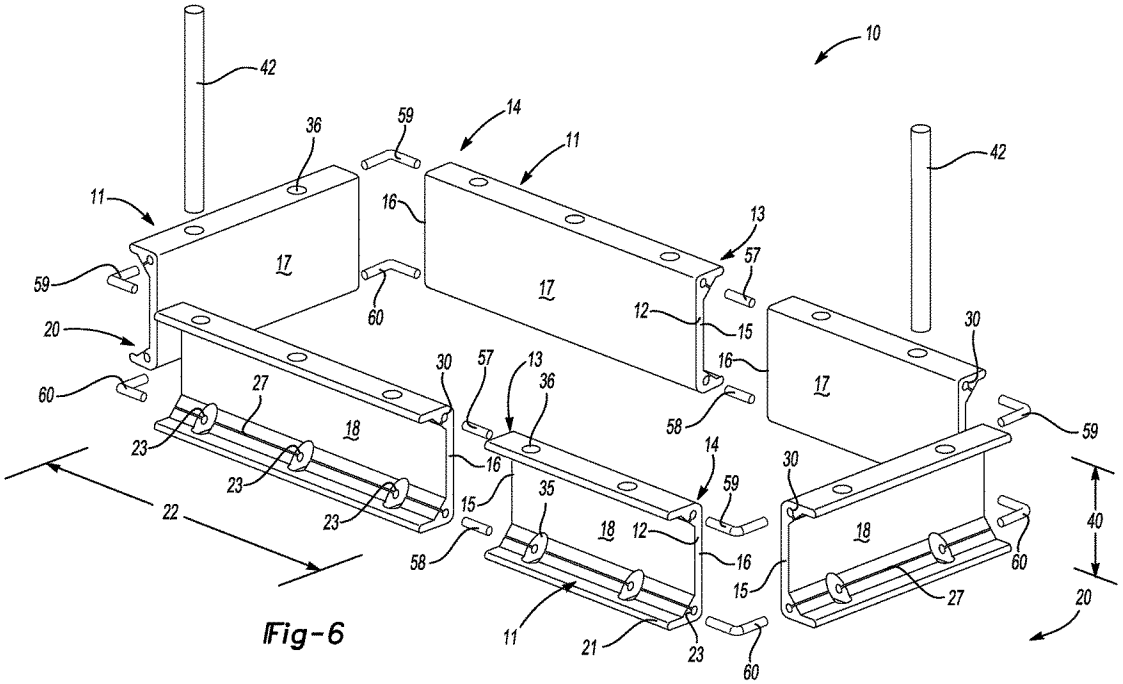
FIG. 6 is an exploded view of the embodiment of FIG. 1.

Referring to FIGS. 1, 2 and 6, containment system 10 for curable construction materials is shown. Containment system 10 includes a plurality of forms 11. Each form has elongated, substantially planar wall 12 having first and second ends, 13, 14, respectively. The first and second ends have first and second end surfaces, 15, 16, respectively. Wall 12 has inner and outer surfaces, 17, 18, respectively, and selected thickness 19. Each form 11 is made from material selected from the group consisting of cardboard, corrugated cardboard, corrugated fiberboard, corrugated plastic, plastic foam, expanded foam sheeting, Styrofoam, closed-cell extruded polystyrene foam, expanded polystyrene foam, wood, natural wood, plywood, engineered wood product, engineered wood particle board, OSB, oriented strand board, sheathing, metal, polymer and plastic, or any combination thereof. Lower flange region 20 extends from wall 12. Lower flange region 20 has lower flange 21 substantially running the length 22 of wall 12, and having selected thickness 38. Flange 21 may be substantially perpendicular to wall 12, or may be not perpendicular to wall 12. Bore 23 substantially runs the length 22 of wall 12, and is formed adjacent the wall and flange 21. Bore 23 has inner wall 24. Bore 23 may be of various shapes, including substantially round, oval, triangular, square, hexagonal, etc.

Flange region 20 further has first and second angled surfaces 25, 26, respectively, extending therefrom and running the length 22 of wall 12, wherein channel 27 which extends to bore 23 is formed between the first and second angled surfaces. The surfaces are angled relative to outer wall 18 and lower flange 21.

Figure 3:
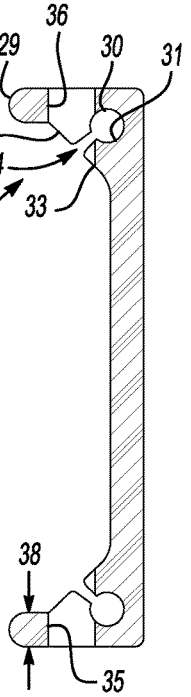
FIG. 3 is a sectional view along arrows 3-3 in FIG. 1.
Figure 4:
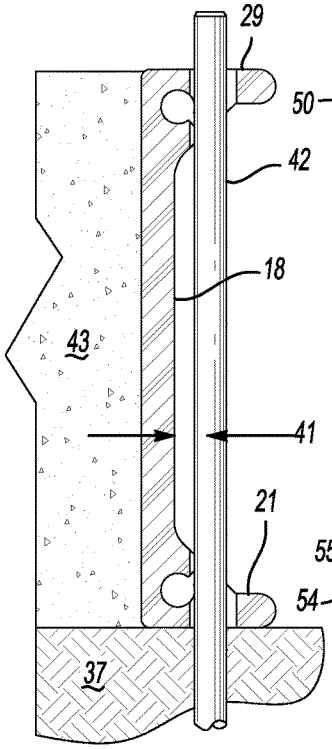
FIG. 4 is a partly sectional view along arrows 4-4 in FIG. 1.

Referring to FIG. 3, a sectional view along arrows 3-3 in FIG. 1 is shown. Form 11 may have upper flange region 28 extending from wall 12. Upper flange region 28 has upper flange 29 substantially running the length 22 of wall 12, and having selected thickness 39. Flange 29 may be substantially perpendicular to wall 12, or may be not perpendicular to wall 12. Bore 30 substantially runs the length 22 of wall 12, and is formed adjacent the wall and flange 29. Bore 30 has inner wall 31. Bore 30 may be of various shapes, including substantially round, oval, triangular, square, hexagonal, etc. Flange region 28 further has first and second angled surfaces 32, 33, respectively, extending therefrom and running the length of wall 12, wherein channel 34 which extends to bore 30 is formed between the first and second angled surfaces. These surfaces are angled relative to outer wall 18 and upper flange 29. Channels 27 and 34 may be tapered at a selected angle A as indicated in FIG. 2. Angle A may be between about six and about twelve degrees. Alternatively, angle A may be between about eight and about ten degrees. Alternatively, angle A may be about nine degrees. The bottom surface of lower flange 21 and top surface of upper flange 29 define a substantially constant height 40 for a given form. See FIG. 6. The invention contemplates forms of various heights to serve specific situations and requirements. Height 40 may be substantially four, six, eight, ten or twelve inches. Height 40 may have other dimensions. Furthermore, the invention contemplates stacking individual forms vertically, and aligning them horizontally using bars installed within apertures in the flanges as described herein, to create overall wall heights of various dimensions. Lower flange 21 may have at least one aperture 35. Upper flange 29 may have at least one aperture 36. Aperture 35 and aperture 36 are substantially aligned. They are provided in order for securing the forms against lateral displacement on grounding surface 37 after rerod 42 is installed within the apertures and then driven into grounding surface 37. See FIGS. 1 and 4. After the rerod has been installed in this fashion, gap 41 may exist between the rerod and outer surface 18. Gap 41 may be less than about 0.2 inch. Alternatively, gap 41 may be less than about 0.1 inch. Alternatively, gap 41 may be about 0.06 inch. Curable construction material 43 is in contact with the inner surface of wall 12.

Figure 5:
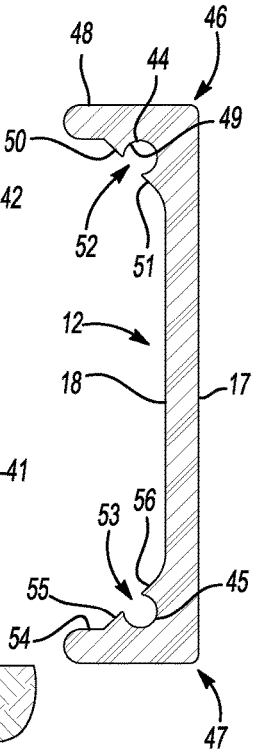
FIG. 5 is a sectional view similar to FIG. 2 for another embodiment of the invention.

Referring to FIG. 5, a sectional view similar to FIG. 2 for another embodiment of form 11 is shown. In this embodiment, form 11 may have upper and lower flange regions 46, 47, respectively, extending from wall 12. Upper flange region 46 has upper flange 48 substantially running the length 22 of wall 12 and having a selected thickness. Flange 48 may be substantially perpendicular to wall 12, or may be not perpendicular to wall 12. Flange region 46 further has first and second angled surfaces 50, 51, respectively, extending therefrom and substantially running the length 22 of wall 12. These surfaces are angled relative to outer wall 18 and upper flange 48. Bore 44 substantially runs the length 22 of wall 12, and is formed adjacent the wall and flange 48. Bore 44 has inner wall 49. Compared to FIG. 2, upper bore 44 of FIG. 5 is translated toward the angled surfaces, 50, 51, so that inner bore wall 49 intersects the angled surfaces. Bore 44 can alternately be described as forming channel 52. Bore 44 may be of various shapes, including substantially round, oval, triangular, square, hexagonal, etc. Bore 44 may also be described as partially round, oval, triangular, square, hexagonal, etc. Lower flange region 47 has lower flange 54 substantially running the length 22 of wall 12 and having a selected thickness. Flange 54 may be substantially perpendicular to wall 12, or may be not perpendicular to wall 12. Flange region 47 further has first and second angled surfaces 55, 56, respectively, extending therefrom and substantially running the length 22 of wall 12. These surfaces are angled relative to outer wall 18 and lower flange 54. Bore 45 substantially runs the length 22 of wall 12, and is formed adjacent the wall and flange 54. Bore 45 has an inner wall similar to that of inner wall 49. Compared to FIG. 2, the lower bore of FIG. 5 is translated toward the angled surfaces, 55, 56, so that its inner bore wall intersects the angled surfaces. Bore 45 can alternately be described as forming channel 53. Bore 45 may be of various shapes, including substantially round, oval, triangular, square, hexagonal, etc. Bore 45 may also be described as partially round, oval, triangular, square, hexagonal, etc.

Referring to FIG. 6, an exploded view of containment system 10 is shown. A plurality of forms 11 are arranged so their inner walls 17 face inwardly, toward the construction material to be poured within the forms. Each form 11 is placed either in-line or at a substantially right angle to adjacent forms, and spaced a distance from adjacent forms. Pins are inserted into the bores of the forms. The dimensions of the pins and bores may be selected to produce a selected insertion force. Flexure of the flange regions upon pin insertion due to the geometries/dimensions of the bores and channels may also be used to produce a selected insertion force for installing the pins. Pins 57, 58 are straight, and used to create a form of a given length by butting together first and second end surfaces 15, 16. Pins 59, 60 have ends at substantially ninety degree angles, and are used at corners to retain adjacent forms together, as shown in FIG. 1, prior to pouring the construction material. Alternatively, first and second ends, 13, 14, may be cut, according to a plan view, at 45 degree angles and matched together using angled pins to create form sections at ninety degrees with respect to one another. See also FIG. 10 for an example of cutting forms in this fashion, for example, at sixty degree angles to create a hexagon form.

Figure 7:
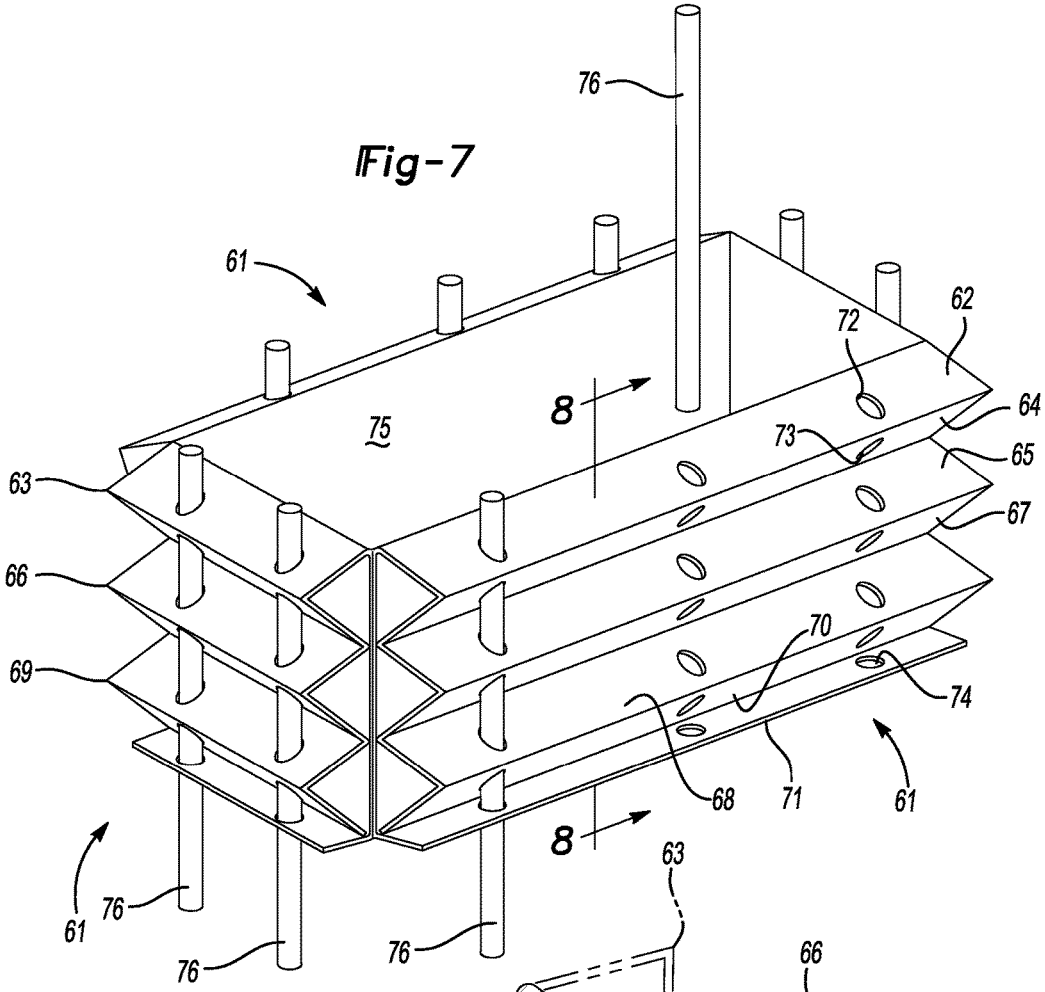
FIG. 7 is an isometric view of another embodiment of the invention.

Referring to FIG. 7, an isometric view of another embodiment of the invention is shown. Four forms 61 are assembled to form a containment system for construction materials. Each form has at least one geometric feature for increasing the rigidity of the form. Each form may have one such geometric feature. Alternatively, each form may have two such geometric features. Alternatively, each form may have three such geometric features, etc. The first geometric feature is created by layers 62, 64, which form an apex similar to the apex at 63, and may be described as substantially "triangular" when taken together with the layer having inner wall 75. The second geometric feature is created by layers 65, 67, which form an apex similar to the apex at 66, and may be described as substantially "triangular" when taken together with layer having inner wall 75. The third geometric feature is created by layers 68, 70, which form an apex similar to the apex at 69, and may be described as substantially "triangular" when taken together with layer having inner wall 75. The geometric features may have a plurality of apertures such as those shown at 72, 73. Inner wall 75 of the form makes contact with the selected construction material. Layer 75 may have foot 71 extending from it substantially along the length of form 61. Foot 71 may have a plurality of apertures such as at 74.

Figure 9:
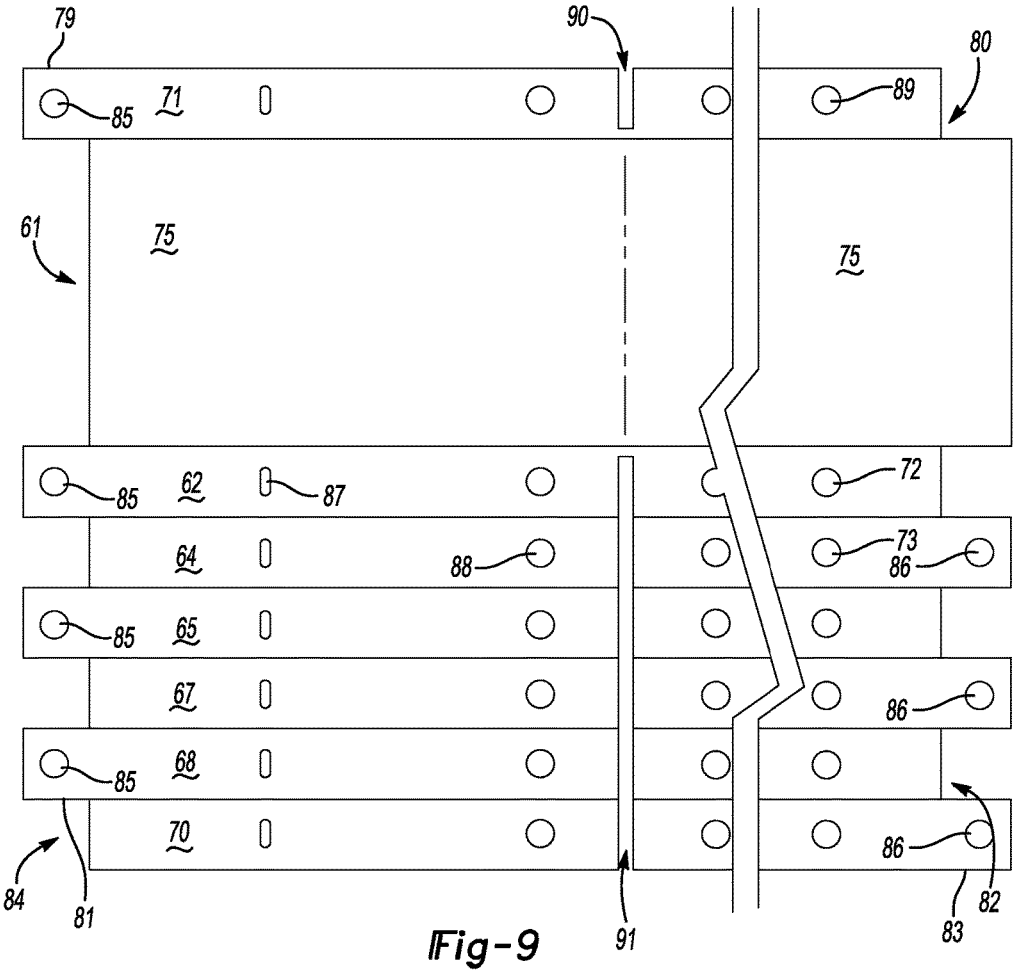
FIG. 9 is a top view of the form of FIG. 8—prior to folding it for use—including tongues and grooves or slots.

Referring to FIG. 9, a top view of form 61 is shown prior to folding it for use. The form includes inner wall layer 75, foot 71, and geometric feature layers 62, 64, 65, 67, 68 and 70. A plurality of apertures is shown at 72, 73, 85, 86, 87, 88 and 89. After folding for use, and positioning a plurality of forms in their desired locations, each of these apertures will be used for positioning bars for insertion through the apertures and then driving the bars into a grounding surface (see FIG. 7). Apertures such as those indicated at 72, 73, 87, 88 and 89 would be used for bars like bars 76 in FIG. 7. Apertures such as those indicated at 85, 86, would be used for bars which connect forms butted together to create a containment system (not shown) with a desired overall length. Tongues, such as the ones at 79, 81, 83, and grooves or slots, such as the ones at 80, 82, provide a method for partially overlapping and connecting the butted forms. A common bar 76 passing through apertures 85, 86, permits this method of use. The apertures described herein may be of various shapes, including substantially round, oval or slotted (for example, "racetrack" slotted). Substantially oval or slotted apertures may permit removal of less of the layer material when creating the apertures during manufacturing. This may improve the strength and/or rigidity of the geometric features. Substantially oval or slotted apertures may permit more accurate horizontal positioning of the forms on the ground, because they will more closely contain the bars while at the same time facilitating insertion of the bars through the forms and into the ground. Channels 90, 91, permit form 61 to be folded along a line as indicated in FIG. 9 to temporarily reduce the overall length of individual forms for ease of transportation.

Figure 8:
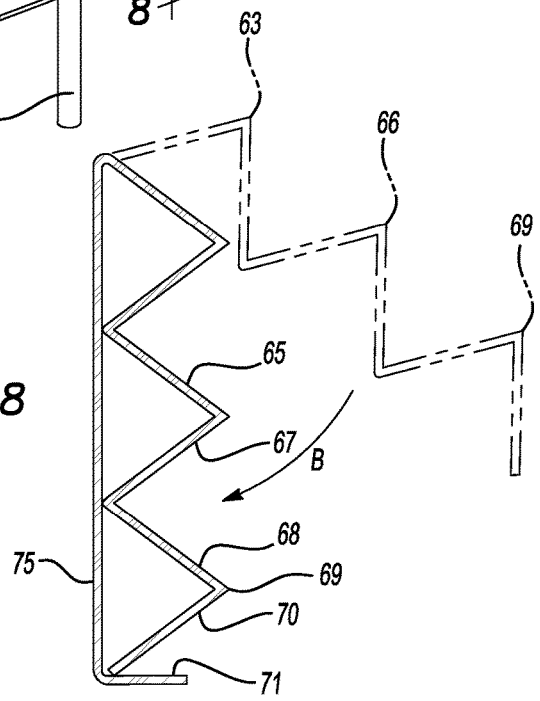
FIG. 8 is a sectional view along arrows 8-8 in FIG. 7.

Referring to FIG. 8, a side view of a form 61 from FIG. 7 is shown. Geometric features having apexes at 63, 66, 69, are folded down (according to arrow B) from the top of the layer having inner wall 75. This is after the folding has occurred to create the geometric features. Layer 70 may contact foot 71 when the form is used.

Figure 10:
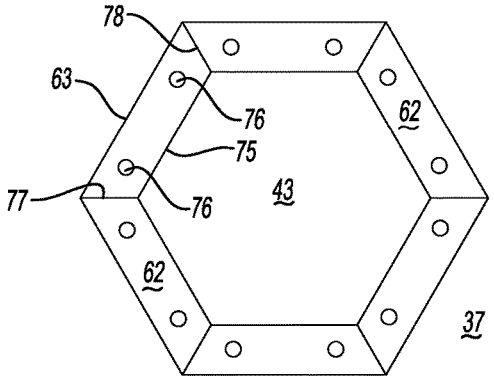
FIG. 10 is a top view of assembled forms of FIG. 8 showing an example of cutting the ends of individual forms as desired.

Referring to FIG. 10, a top view of assembled forms shows an example of cutting the ends of individual forms as desired, for example at sixty degree angles according to a plan view, to create a hexagon containment system for curable construction material 43. This system has inner walls such as at reference sign 75, geometric features with upper layers such as at 62 and apexes such as at 63, and angled ends such as at 77, 78. The system is secured to grounding surface 37 using bars such as at 76.

Figure 11:
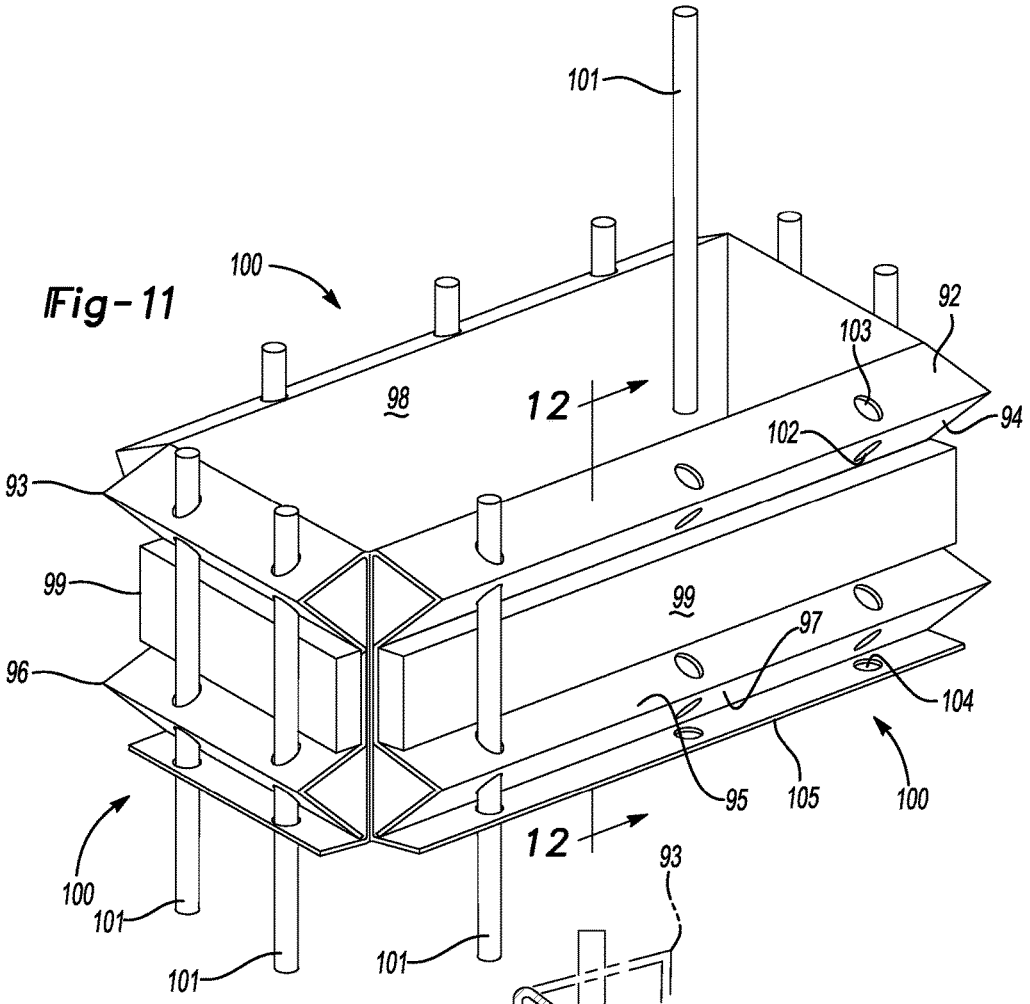
FIG. 11 is an isometric view of another embodiment of the invention.

Referring to FIG. 11, an isometric view of another embodiment of the invention is shown. Four forms 100 are assembled to form a containment system for construction materials. Each form has at least one geometric feature for increasing the rigidity of the form. Each form may have one such geometric feature. Alternatively, each form may have two such geometric features. Alternatively, each form may have three such geometric features, etc. The first geometric feature is created by layers 92, 94, which form an apex similar to the apex at 93, and may be described as substantially "triangular" when taken together with the layer having inner wall 98. The second geometric feature is created by layers 95, 97, which form an apex similar to the apex at 96, and may be described as substantially "triangular" when taken together with layer having inner wall 98. Intermediate to the first and second geometric features is reinforcing member or reinforcing backer or stiffback 99. Reinforcing member 99 may be integrally formed with form 100. Alternatively, reinforcing member 99 may be formed as a separate component and then secured to form 100 prior to using the form. Alternatively, reinforcing member 99 may be a separate component and not substantially secured to form 100, but inserted into its proper position as shown in FIG. 11 before or after staking form 100 in place on the ground. The reinforcing backer may be made of wood, metal, plastic, composite, or any combination thereof. The reinforcing member may be a piece of lumber, for example, having dimensions of about 1.5 inch by 3.5 inch. The geometric features may have a plurality of apertures such as those shown at 102-104. In use, inner wall 98 of the form makes contact with the selected construction material. The layer having inner wall 98 may have foot 105 extending from it substantially along the length of form 100. Foot 105 may have a plurality of apertures such as the one at 104. Layer 97 may contact foot 105 when the form is used. The forms are secured to a grounding surface using bars such as at 101.

Figure 12:
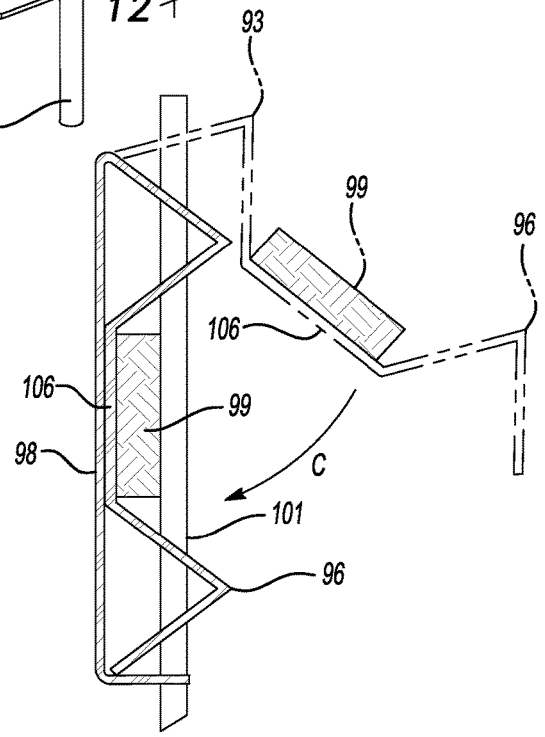
FIG. 12 is a sectional view along arrows 12-12 in FIG. 11.

Referring to FIG. 12, a side view of a form 100 in FIG. 11 is shown. Geometric features having apexes at 93, 96, are folded down (according to arrow C) from the top of the layer having inner wall 98. This is after the folding to create the geometric features has occurred. Reinforcing member 99 may be in contact with layer 106 of form 100 when folding it according to arrow C. Alternatively, reinforcing member 99 may be slid into position between layer 106 and bar 101 after the form is secured to the ground, generally before curable construction material is placed within the containment system.

The containment system and method(s) of using are further described as follows:

A method of using a containment system, comprising:

locating a first and second wall structures on a surface;

orienting the wall structures with respect to the surface;

orienting the wall structures with respect to each other, wherein substantially flat first portions of the wall structures substantially form a containment region or space;

substantially fixing the wall structures in their orientation to the surface and each other using a plurality of load-bearing structures in contact with the surface and/or the region below the surface and the wall structures; and providing a pourable material composition within the containment region or space.

The method of using a containment system above, further comprising:

removing the wall structures and load-bearing structures after a selected time has elapsed.

The method of using a containment system above, further comprising:

removing the wall structures and load-bearing structures after the pourable material composition has substantially cured and/or hardened.

A containment system, comprising:

a sheet of cardboard;

a cardboard structure having first and second components, the first component being substantially flat, the second component not being substantially flat.

A containment system, comprising:

a wall structure having first and second portions, the first portion being elongated and substantially flat, the first and second portions having first and second selected thicknesses, respectively, the first and second portions together having or forming a selected overall cross-sectional shape;

wherein the selected cross-sectional shape is selected from the group consisting of substantially polygonal, triangular, rectangular, square, box, U-shape, W-shape, M-shape, Z-shape, T-shape, L-shape, J-shape, curved, arcuate, semicircular, and/or any combination thereof;

wherein the first and second portions are adjacent one another and connected to one another, the first and second portions further having first and second portion longitudinal, lateral and vertical axes, respectively;

wherein the wall structure is made from material(s) selected from the group consisting of cardboard, corrugated cardboard, corrugated fiberboard, corrugated plastic, plastic foam, expanded foam sheeting, Styrofoam, closed-cell extruded polystyrene foam, expanded polystyrene foam, wood, natural wood, plywood, engineered wood product, engineered wood particle board, OSB, oriented strand board, sheathing, metal, polymer and plastic, and/or any combination thereof;

a load-bearing structure, wherein the load-bearing structure is selected from the group consisting of a stake, post, stick, dowel, channel, piece of angle iron, bar, reinforcing bar, rebar, rod, rerod, reinforcing wire, structure substantially extending below the surface of the ground, structure not substantially extending below the surface of the ground;

further wherein the load-bearing structure is made from material(s) selected from the group consisting of metal, polymer, plastic, wood, and/or any combination thereof; and wherein the load-bearing structure is engaged with/in contact with the wall structure.

A containment system, comprising:

a wall structure having first and second portions, the first portion being elongated and substantially flat, the first and second portions having first and second selected thicknesses, respectively, the first and second portions together having or forming a selected overall cross-sectional shape (or the second portion having or forming a selected cross-sectional shape);

wherein the selected cross-sectional shape is selected from the group consisting of substantially polygonal, triangular, rectangular, square, box, U-shape, W-shape, M-shape, Z-shape, T-shape, L-shape, J-shape, curved, arcuate, semicircular, and/or any combination thereof;

wherein the first and second portions are adjacent one another and connected to one another, the first and second portions further having first and second portion longitudinal, lateral and vertical axes, respectively;

wherein the wall structure is made from material(s) selected from the group consisting of cardboard, corrugated cardboard, corrugated fiberboard, corrugated plastic, plastic foam, expanded foam sheeting, Styrofoam, closed-cell extruded polystyrene foam, expanded polystyrene foam, wood, natural wood, plywood, engineered wood product, engineered wood particle board, OSB, oriented strand board, sheathing, metal, polymer and plastic, and/or any combination thereof;

a load-bearing structure, wherein the load-bearing structure is selected from the group consisting of a stake, post, stick, dowel, channel, piece of angle iron, bar, reinforcing bar, rebar, rod, rerod, reinforcing wire, structure substantially extending below the surface of the ground, structure not substantially extending below the surface of the ground;

further wherein the load-bearing structure is made from material(s) selected from the group consisting of metal, polymer, plastic, wood, and/or any combination thereof; and wherein the load-bearing structure is engaged with/in contact with the wall structure.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the following claims.

The invention claimed is:

1. A form for curable construction materials, comprising:

an elongated, substantially planar wall having a selected thickness, the wall having inner and outer surfaces;

a flange region extending from the wall, the flange region having a flange substantially running the length of the wall, wherein a bore substantially running the length of the wall is formed adjacent to the wall and the flange;

the flange region further having first and second angled surfaces extending therefrom, wherein a channel extending to the bore is formed between the first and second angled surfaces;

the flange region having at least one aperture;

upper and lower flange regions;

wherein the wall has a substantially constant height;

wherein the flange is substantially perpendicular to the wall;

wherein the bore is substantially round;

the channel being tapered;

the taper being nine degrees;

wherein in use, a substantially 0.060 inch space exists between the rebar and outer surface of the wall;

flange having a selected thickness.

2. A containment system for curable construction materials, comprising:

a plurality of forms, each form comprising an elongated, substantially planar wall having a selected thickness, the wall having inner and outer surfaces, and a flange region extending from the wall, the flange region having a flange substantially running the length of the longest dimension of the wall, wherein a bore substantially running the length of the longest dimension of the wall is formed adjacent to the wall and the flange, the flange having a selected thickness; and a plurality of pins, wherein the pins connect adjoining forms, further wherein the pins are inserted into the respective bores of the adjoining forms to create the containment system;

the flange region further having first and second surfaces extending therefrom, wherein a channel extending to the bore is formed between the first and second surfaces.

* * * * *